US008677864B1

(12) United States Patent
Wheeler

(10) Patent No.: US 8,677,864 B1
(45) Date of Patent: Mar. 25, 2014

(54) COMPACT CAM ACTUATED ADJUSTABLE SOCKET

(76) Inventor: Thomas J Wheeler, Pomona, CA (US)

( * ) Notice: Subject to any disclaimer, the term of this patent is extended or adjusted under 35 U.S.C. 154(b) by 491 days.

(21) Appl. No.: 13/096,997

(22) Filed: Apr. 28, 2011

Related U.S. Application Data

(60) Provisional application No. 61/343,418, filed on Apr. 29, 2010.

(51) Int. Cl.

| | |
|---|---|
| ***B25B 13/06*** | (2006.01) |
| ***B25B 13/00*** | (2006.01) |
| ***B25B 13/02*** | (2006.01) |
| ***B25B 13/18*** | (2006.01) |
| ***B25B 13/12*** | (2006.01) |

(52) U.S. Cl.
USPC ..... 81/128; 81/121.1; 81/124.2; 81/124.3; 81/125; 81/129

(58) Field of Classification Search
USPC ..... 81/121.1, 124.2, 124.3, 125, 128, 129
See application file for complete search history.

(56) References Cited

U.S. PATENT DOCUMENTS

| | | | | |
|---|---|---|---|---|
| 915,443 | A * | 3/1909 | Jones | 81/62 |
| 2,884,826 | A * | 5/1959 | Bruhu | 81/128 |
| 4,520,698 | A * | 6/1985 | Martinmaas | 81/128 |
| 4,884,480 | A * | 12/1989 | Briese | 81/128 |
| 5,996,446 | A * | 12/1999 | Lee | 81/128 |
| 6,971,284 | B2 * | 12/2005 | Owoc | 81/58.2 |
| 7,261,021 | B1 * | 8/2007 | Carnesi et al. | 81/128 |
| 7,946,200 | B2 * | 5/2011 | Chang | 81/128 |
| 8,424,422 | B2 * | 4/2013 | Liang | 81/128 |

* cited by examiner

*Primary Examiner* — Monica Carter
*Assistant Examiner* — Danny Hong
(74) *Attorney, Agent, or Firm* — Gary Hoenig

(57) ABSTRACT

A wrench drive socket having jaws, actuated by a cam mechanism, facilitating the accommodation of a range of faceted work pieces is provided wherein adjustment of the distance between the jaws having V-shaped grips is accomplished by rotation of a knurled adjustment collar circumferentially disposed around a socket sleeve and fixed to an internally positioned jaw guide, the rotation of the jaw guide selectably positioning cam followers on the jaws against arch shaped cam profiles fashioned along the inside circumference of the socket sleeve, the sleeve being fixed to a centrally disposed socket body having an engaging hole to receive a drive shaft of a wrench such as a ratchet wrench. The adjustable drive socket provides advantages over the prior art including simplified construction, convenience of use, durability, effectiveness, and cost and weight reduction through the elimination of a plurality of sockets having fixed sizes.

13 Claims, 6 Drawing Sheets

COMPACT CAM ACTUATED ADJUSTABLE SOCKET

FIELD OF THE INVENTION

The present invention relates to the field of wrench tools. More particularly, this invention is directed to a wrench drive socket with adjustable jaws by means of a cam actuated mechanism.

BACKGROUND OF THE INVENTION

Various types of adjustable wrench drive sockets having adjustable jaws to grip a range of sizes or diameters of bolts, nuts or other fasteners have been provided with varying mechanisms, often of complex design, for tightening various forms of jaws up against a work piece fastener and with varying degrees of acceptance. Adjustable drive sockets typically have an annularly mounted mechanism wherein a rotatable element is rotated by an operator to adjust the jaws inwardly or outwardly to match the size of the work piece fastener. One such prior art socket taught by Lee (U.S. Pat. No. 5,996,446) is typical of adjustable jaw mechanisms wherein jaw elements have detent features, in this case teeth, selectably engaged by rotation of a control element defining predetermined fixed distances between the jaws. The detent features typically are intended to lock the jaw distance, and hence the size, such that the jaw spacing remains fixed as load is applied to the socket, else slippage of the jaw positioning can occur. Slippage manifests as an opening of the jaws causing, at minimum, poor fit of the socket to a work piece, inefficient load transfer to the work piece, risk of damage to the work piece mating surfaces and/or the socket and possible injury to the user upon sudden disengagement. Configurations requiring jaw locking mechanisms further necessitate that the locking mechanism bear much of the transfer load therefore requiring substantial load bearing capacity as provided by costly harden steel components. Hence, the load capacity of adjustable sockets is often limited as compared to a standard solid socket. In any case, the inherent characteristics of such mechanisms result in the socket having a propensity to increase the jaw spacing under load.

An object of using an adjustable socket is to minimize the number of sockets required in a tool set. The size adjustment range of the typical adjustable socket is limited. Typically, adjustable sockets have a relatively small size adjustment range thereby necessitating a number of adjustable sockets, albeit fewer than required in a fixed socket set.

In view of the load, grasping force, size, and range limitations of the typical prior art socket, the herein disclosed invention is provided to overcome the many disadvantages.

SUMMARY OF THE INVENTION

Accordingly, it is an object of the present invention to provide a new type of adjustable wrench drive socket having a cam actuated mechanism and features to simplify the structure and construction, advance its convenience of use, durability and effectiveness while accommodating a wide and continuous range of faceted work piece sizes. The simplicity of the socket minimizes the size and the number of elements as well as the manufacturing cost.

The present invention is a wrench drive socket having adjustable jaws, actuated by a cam mechanism, facilitating the accommodation of a range of sizes of faceted work pieces is provided wherein adjustment of the distance between the jaws having V-shaped grips is accomplished by rotation of a knurled adjustment collar circumferentially disposed around a socket sleeve and fixed to an internally positioned jaw guide, the rotation of the jaw guide selectably positioning cam followers on the jaws interacting with and against arch shaped cam profiles fashioned along the inside circumference of the socket sleeve, the sleeve being fixed to a centrally disposed socket body having an engaging hole to receive a drive shaft of a wrench such as a ratchet wrench.

In use, load is transferred from a provided wrench, to the socket body, to the sleeve cam profiles, to the jaws and then to an engaged provided work piece. The user first positions the socket over a provided work piece, then rotates the adjustment collar to engage jaws against the work piece. As torque is applied to the socket by means of the provided wrench or other drive tool, load is transferred through the cam mechanism arranged such that increasing torque levels result in a load vector forcing the jaws of the socket together to increase the grasp of the work piece. The interaction of cam profiles with cam followers on the jaws further provide continuous adjustment of the distance between the jaws hence providing infinite size adjustment throughout the range of the socket. The cam profiles are disposed so as to facilitate both clockwise and counterclockwise application of torque. The cam actuation features provide a means to significantly reduce the risk of slippage and disengagement of the socket from a work piece under torque by means of the jaw tightening action thereby also reducing the risk of damage to the work piece. The cam actuation features further provide for a small and compact design while capable of handling higher torque load than available in a similar sized adjustable socket.

It will be appreciated that many other additional benefits are provided by the cam actuation mechanism. The adjustable drive socket provides advantages over the prior art including simplified construction, convenience of use, compact size, durability, effectiveness, and cost and weight reduction through the elimination of a plurality of sockets having fixed sizes.

BRIEF DESCRIPTION OF THE DRAWINGS

The accompanying drawings, which are incorporated in and constitute a part of this specification illustrate embodiments of the invention and, together with the description, serve to explain the features, advantages, and principles of the invention.

DETAILED DESCRIPTION OF THE INVENTION

Figure 1:
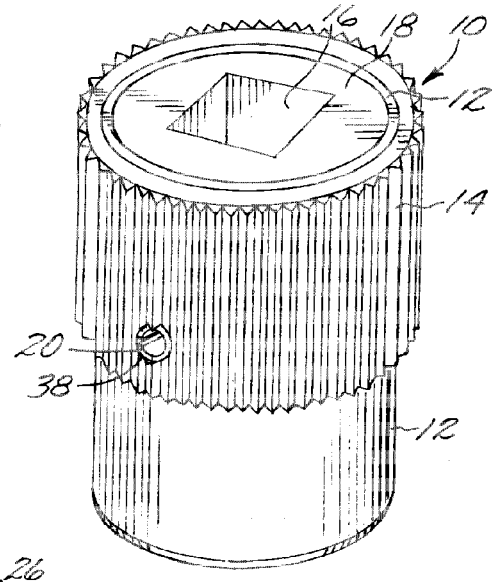
FIG. 1 is a top perspective view of an embodiment of the adjustable socket according to the present invention showing the knurled adjustment collar and the centrally disposed engaging hole for mating with a square end fitting of a wrench.

Although particular embodiments of the invention have been described in detail for purposes of illustration, various modifications may be made without departing from the spirit and scope of the invention. Accordingly, the invention is not to be limited except as by the appended claims. Referring now in greater detail to the various figures of the drawings wherein like reference characters refer to like parts, there is shown in a perspective view at 10 in FIG. 1, a new type of adjustable wrench drive socket facilitated by a cam mechanism.

Figure 2:
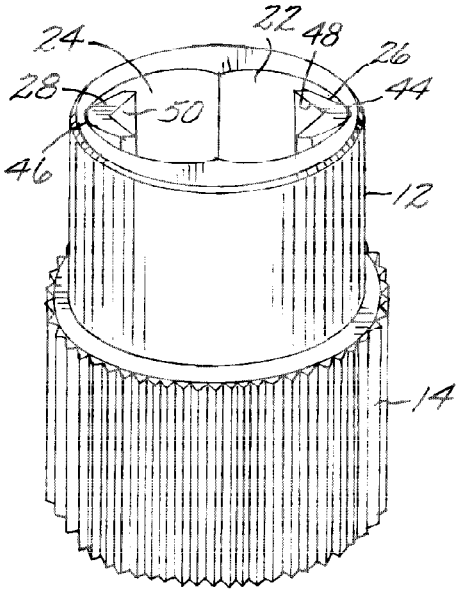
FIG. 2 is a bottom perspective view of the adjustable socket illustrating the selectably adjustable jaws by means of rotation of the knurled adjustment collar relative to the body of the socket.

Referring now to FIGS. 1 and 2 illustrating a top and a bottom perspective view respectively of the adjustable wrench drive socket 10 according to the present invention comprising a knurled adjustment collar 14 circumferentially surrounding a socket sleeve 12 wherein the knurled adjustment collar 14 is fixed by collar pin 20 through collar pin bore 38 and a horizontally and circumferentially disposed slot 23 in the cylindrical sleeve 12 to a jaw guide positioned concentrically within the sleeve 12 and receiving a first and second jaw 26 and 28 each having a V-shaped grip 48 and 50 and a cam follower 44 and 46 surface respectively disposed and compression spring biased to contact arch-shaped cam profile surfaces 22 and 24 that form the lower portion of the inside surface of sleeve 12. The jaws 26 and 28 are positioned opposingly and follow the sleeve cam profile surfaces 22 and 24 in response to a rotation of the knurled adjustment collar 14 around and relative to the sleeve 12. The cam profile surfaces 22 and 24 are the same and disposed with the bottom of the arches touching therefore resemble mirrored arches wherein the sleeve 12 wall thickness is at a minimum at the top of the arch and the wall thickness is at a maximum at the intersection of the cam profile surfaces. Being symmetrically shaped arch profiles, the cam profiles are centered along a diameter of the sleeve 12. Rotating the circumferential position of the knurled adjustment collar 14 necessarily repositions the cam followers 44 and 46 to complimentary positions along the profiles moving the jaws 26 and 28 closer together as the sleeve 12 wall thickness increases responsive to the repositioning of the contact point between the jaw cam followers 44 and 46 lower towards the bottom end along the arch-shaped cam profiles. Maximum distance between the jaw V-shaped grips 48 and 50 is attained when the jaw cam followers 44 and 46 are positioned at the top of the cam profiles 22 and 24. The socket sleeve 12 is fixed to the socket body 18 concentrically disposed within the top portion of the socket sleeve 12, the top portion of the sleeve 12 having a cylindrical inner surface thereby forming an annular opening to receive the socket body 18. The socket body 18 having a top and bottom surface, the top surface comprises an engaging hole 16 for receiving the drive shaft of a wrench or other tool.

Figure 3:
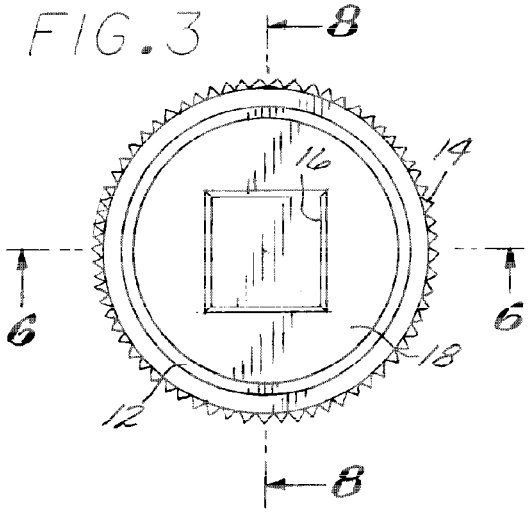
FIG. 3 is a top plan view of the present invention showing the concentric disposition of the wrench engaging hole and the circumferentially disposed adjustment collar.

In FIG. 3, a top plan view of the adjustable socket, the socket body 18 is illustrated, being fashioned from a solid cylindrically shaped element and fitting within the sleeve 12, has the drive shaft engaging hole 16 centrally located such that the socket 10 mounts concentrically to a provided drive shaft. The knurled adjustment collar 14 is disposed in a manner so as to provide sufficient clearance between the outside surface of the sleeve 12 and the inner cylindrical surface of the collar 14 to allow free rotational movement of the collar 14 around the sleeve 12.

Figure 4:
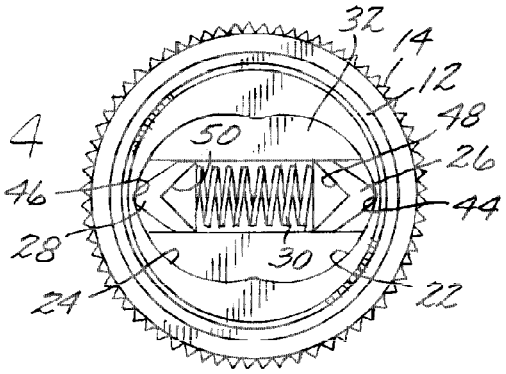
FIG. 4 is a bottom plan view of the adjustable socket showing the inner cam surfaces, adjustable jaws and compression spring forming the work piece grip portion for grasping a provided faceted work piece such as a bolt or nut.

The jaw and cam mechanisms are more clearly seen in the bottom plan view of FIG. 4. First and second jaws 26 and 28 each having a cam follower 46 and 48 disposed opposite V-shaped grips 48 and 50, have their respective cam followers 46 and 48 biased against the sleeve 12 cam profile surfaces 22 and 24. The jaws 26 and 28 are free to slide within a guide slot 56 of the jaw guide 32 being biased outwards against the cam profile surfaces 22 and 24 by a guide compression spring 30. The jaw guide 32 is centrally rotatable within the sleeve 12 such that rotation of the jaw guide 32 relative to the sleeve 12 repositions the jaw cam followers 46 and 48 at selected complementary positions along the arch shaped profiles. The knurled adjustment collar 14 surrounding the outside circumference of the sleeve 12 and being pinned through a horizontally disposed slot in the sleeve 12, thereby facilities a user to select the distance between the V-shaped grips 48 and 50 of the jaws 26 and 28 by rotating the collar 14 around the sleeve 12.

Figure 5:
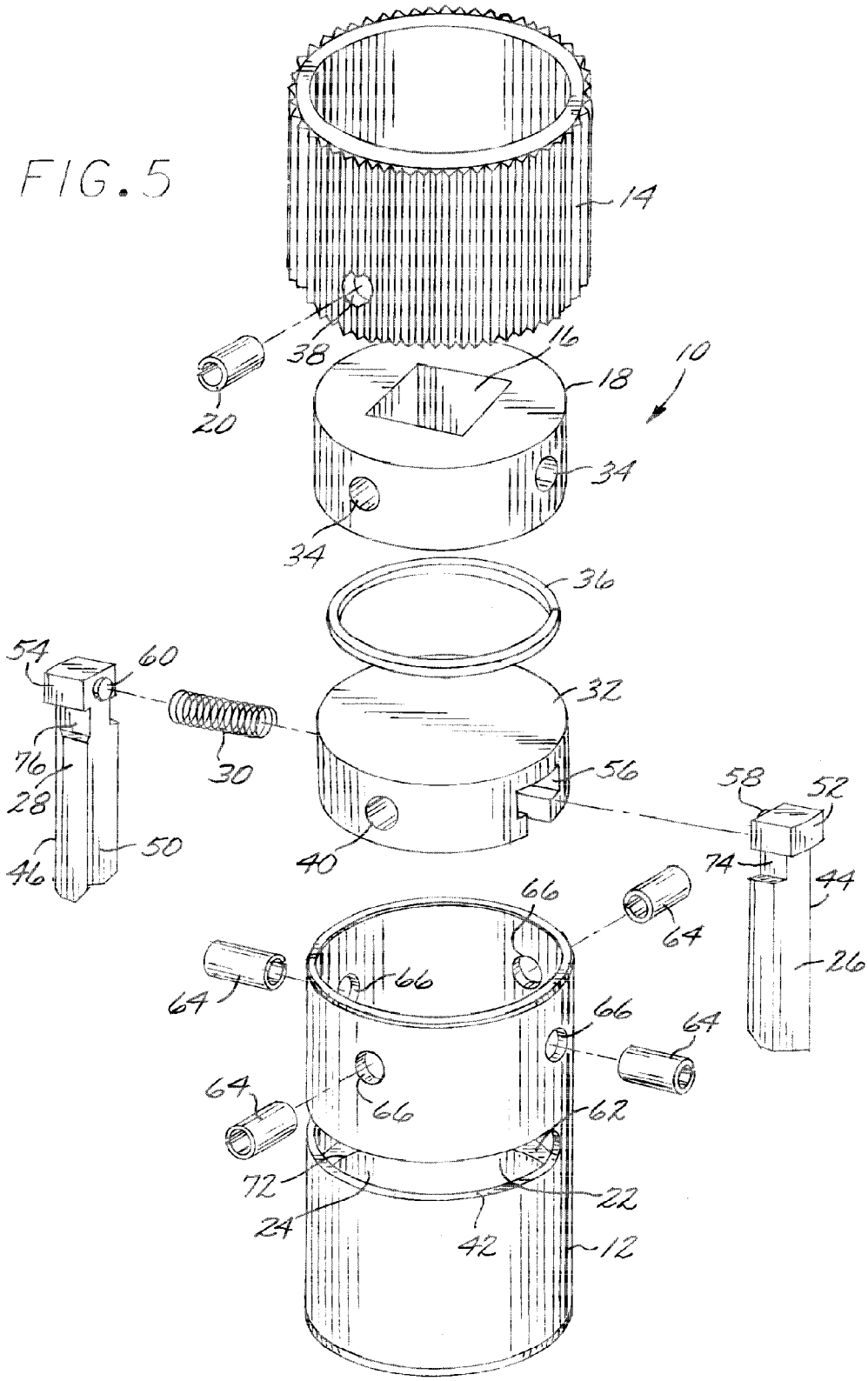
FIG. 5 is an exploded view of the adjustable socket showing the spatial relationship and connectivity of the elements of the socket.

FIG. 5 provides a perspective exploded view according to the present invention illustrating the spatial relationship between the various elements of the socket. Beginning from the top end of the socket, the knurled adjustment collar 14, being cylindrically shaped, has a knurled outside surface for user grip and has a smooth cylindrical surface on the inside commensurate with free rotation around the outside surface of sleeve 12. The collar pin 20 is mounted in collar pin bore 38 penetrating through the collar 14. Collar pin 20 is received by jaw guide collar pin receiving bore 40 and restricts the rotational range of the knurled adjustment collar 14 around the sleeve 12 by means of the collar pin slot 42 horizontally and circumferentially disposed in the sleeve 12. The collar pin slot 42 has a centerline at a location corresponding to the bottom of the arch shaped cam profile surfaces 22 and 24. The length of the collar pin slot 42 is engineered such that the knurled adjustment collar 14 may rotate 90 degrees in either direction from the center point of the collar pin slot 42 thereby providing adjustment of the jaws 26 and 28 to be positioned at any point along the cam profiles 22 and 24.

The top portion of sleeve 12 has a cylindrically shaped surface suitable for receiving the jaw guide 32 being a cylindrically shaped element with jaw guide slot 58 in the bottom of the jaw guide 32 and through the diameter. The jaw guide slot 56 is fashioned to accommodate jaw guide slot followers 52 and 54 forming the top of each jaw 26 and 28. The contours of the jaw guide slot 56 and the jaw guide slot followers 52 are selected to capture the jaw within the guide whilst permitting free movement within the slot 56. A jaw compression spring 30 is disposed between the jaw guide slot followers 52 and 54 for biasing the jaws 24 and 26 outwardly. The opposing jaw spring bosses 58 and 60 assist to retain the jaw compression spring 30 between the jaws. The inside surface of the bottom portion of sleeve 12 being the arch shaped cam profiles 22 and 24 necessarily protrude inwardly towards the central axis of the sleeve 12 thereby provide arch shaped cam profile top side surfaces 62 and 72 perpendicular to the central axis defining the transition between the top and bottom portions of the sleeve 12. These profile top side surfaces 62 and 72 confine the bottom surface of the jaw guide 32 while allowing the guide 32 to rotate within the sleeve 12. The top surface of the jaw guide 32 also being flat completes the cylindrical shape of the guide 32 and is suitable for receiving the jaw guide compression spring 36 disposed between the guide 32 and the socket body 14 disposed above the guide 32 within the top portion of the sleeve 12. The socket body 14 has body securing pin receiver bores 34 within the outside circumference of the socket body 14 for retention of body securing pins 64. The receiver bores 34 align respectively with sleeve body securing pin bores 66 in the sleeve 12. The body securing pins 64 have a length so engineered such that when the pin is in place, the distal end of the pin does not protrude beyond the outside surface of the sleeve 12 thereby eliminating interference with surrounding knurled adjustment collar 14. The socket body 14 being a solid cylindrical shape is disposed with the top surface being flush with the top of the socket 10 and has a height to provide sufficient clearance between the bottom of the body 14 and the top of the jaw guide 32 to accommodate the guide compression spring 36.

It will be appreciated that the socket elements are interlocked in such as manner as to permit easy assembly beginning with the jaws and jaw guide components fitted together, then inserted through the top of the sleeve, the guide compression spring fitted with the body inserted and pinned, finally the knurled adjustment collar 14 restricting the body securing pins being pinned through to the jaw guide.

Figure 6:
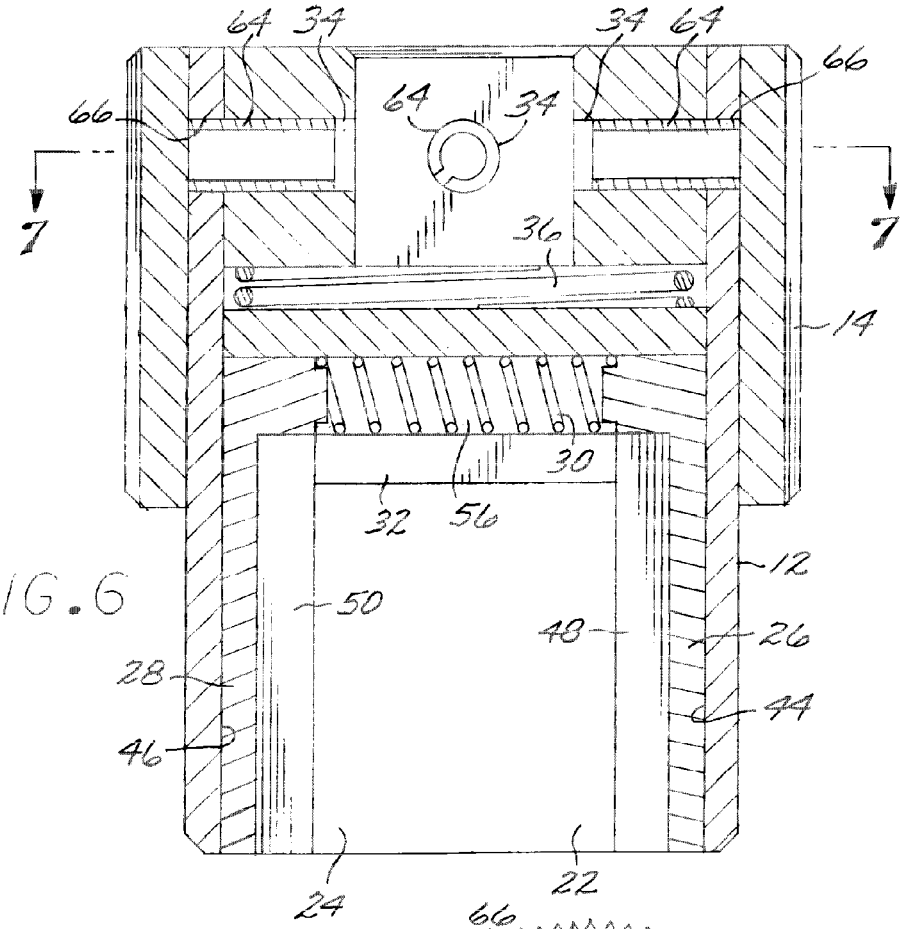
FIG. 6 is a cross section view taken on Line 6-6 of FIG. 3 illustrating the internal elements of the adjustable socket according to the present invention wherein the distance between the jaws is responsive to the rotation of the knurled adjustment collar.

FIG. 6 being a cross section view taken along Line 6-6 of FIG. 3 shows the assembled socket with the jaws 26 and 28 being captured by the jaw guide 32 and jaw cam followers 48 and 50 biased against the arched cam profile surfaces 22 and 24 of the sleeve 12 by compression spring 30.

Figure 7:
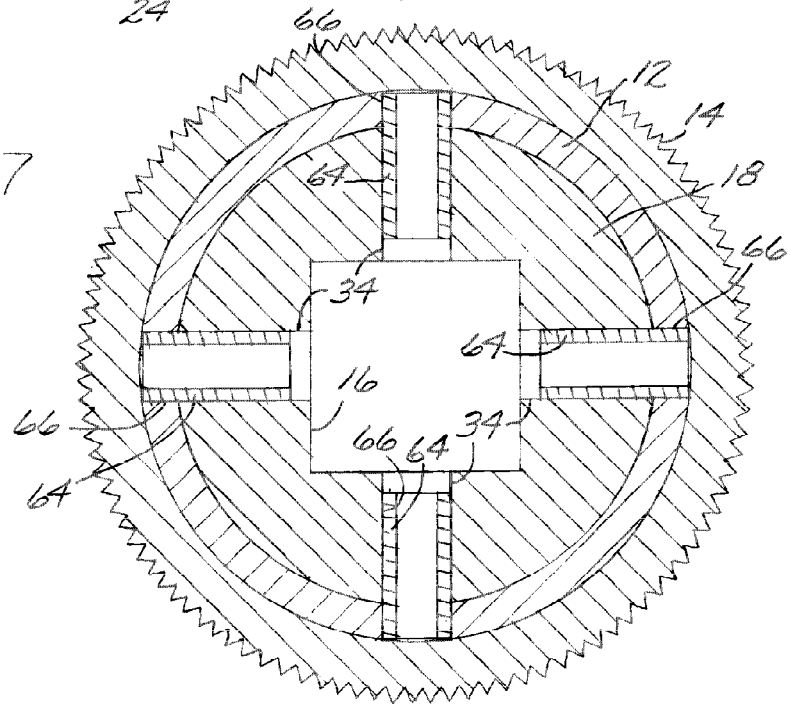
FIG. 7 is a cross section view taken on Line 7-7 of FIG. 6 illustrating the socket body secured centrally within and to the socket cylindrical sleeve by means of pins so arranged as to permit rotation of the knurled adjustment collar around the socket cylindrical sleeve.

Referring also to FIG. 7, a cross section view taken along Line 7-7 of FIG. 6, details of the socket body 18 positioning within the sleeve 12 are illustrated. The radially disposed receiving bores 34 being aligned with sleeve body pin bores 66 together provide retention of the body securing pins 64 and the knurled adjustment collar 14 further confines the body securing pins 64; however, the proximate end of the receiving bores 34 form opens into the drive shaft engaging hole 16 necessitating the body securing pins 34 to fit snugly into the receiving bores 34. Therefore the body securing pins 64 are depicted as roll pin type pins that press outwardly on the bore, other pin types may also be used that provide a compressive fitting within the bore. The embodiment as illustrated shows four body securing pin bores and pins; however, any number may be used. Four bores and pins disposed at 90 degree increments facilitate manufacturing and provide detents in the sides of the drive shaft engaging hole 16 in the top of the socket body 18 formed by the proximate open ends of the body securing pin bores 34. The detent features are suitable for accepting complementing locking features on a provided wrench drive shaft.

Figure 8:
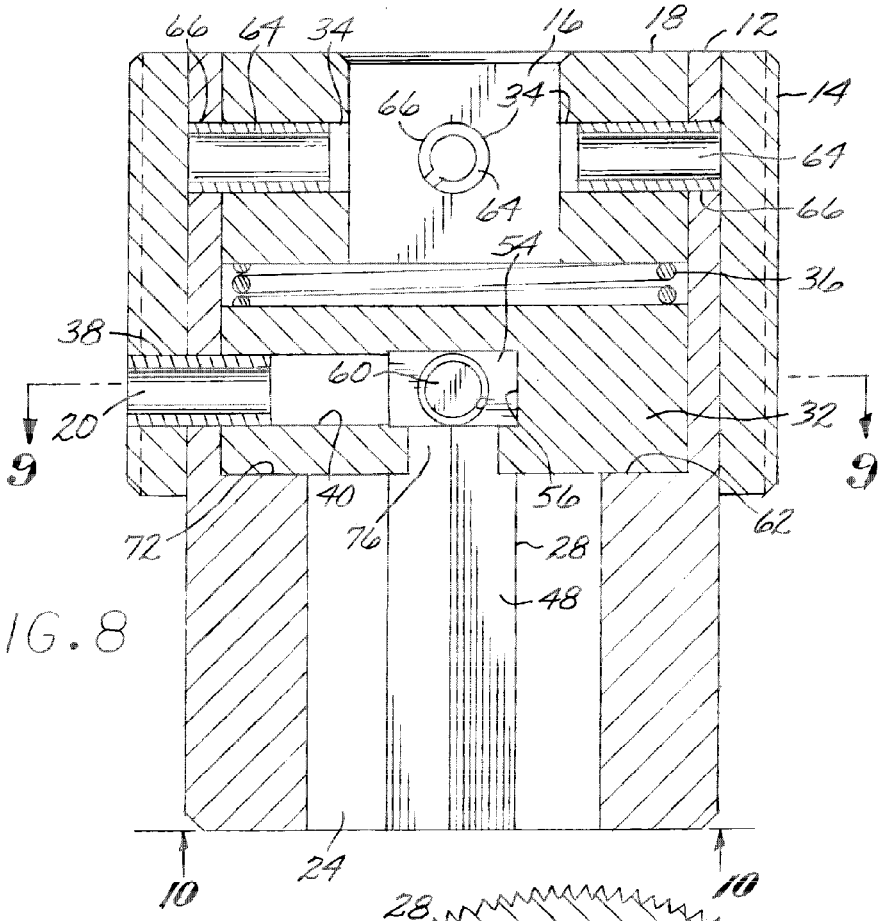
FIG. 8 is cross section view taken on Line 8-8 of FIG. 3 showing the through pinning of the knurled adjustment collar to the inwardly, centrally and concentrically positioned jaw guide wherein the collar pin passes through a horizontally disposed collar slot in the socket cylindrical sleeve such that rotation of the collar necessarily rotates the jaw guide within the socket cylindrical sleeve.
Figure 9:
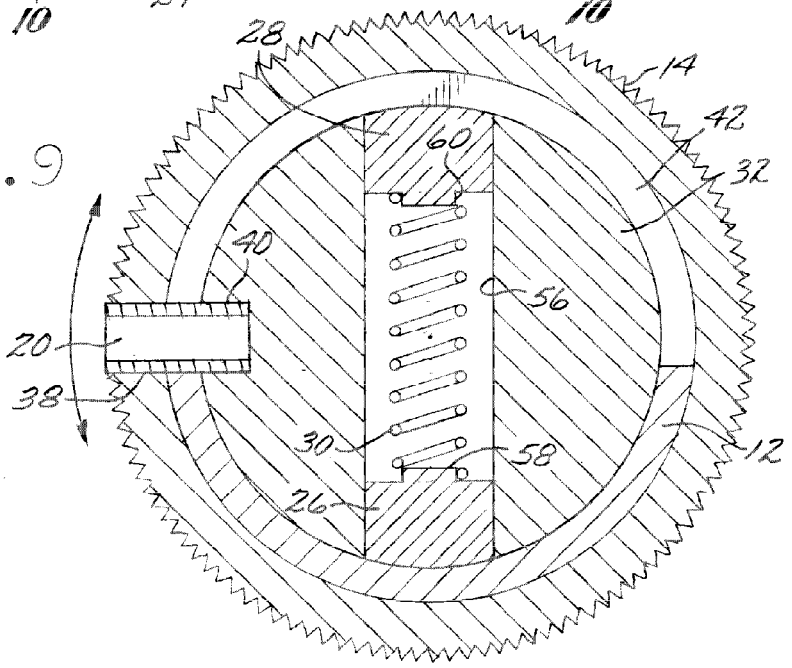
FIG. 9 is a cross section view taken on Line 9-9 of FIG. 8. of the present invention illustrating details of the horizontally disposed collar slot wherein the knurled adjustment collar is adjustable within a 180 degree rotational range.

Referring now to FIG. 8, a cross section view taken along Line 8-8 of FIG. 3, and FIG. 9, a cross section view taken along Line 9-9 of FIG. 8, details of the cam actuated jaw adjustment mechanisms are more clearly illustrated. The jaws have identical construction. The jaw guide slot 56 of the jaw guide 32 captures the jaw guide slot followers 52 and 54 by means of contours engineered to conform with complementary contours of the jaw recessed neck 74 and 78 of the jaws 26 and 28. The jaws 26 and 28 may slide within the jaw guide slot 56 with the V-shaped grip surfaces 48 and 50 facing one another for grasping a facetted work piece. The collar pin receiving bore 40 is radially disposed in the outer circumference of the jaw guide 32 perpendicular to the jaw guide slot 56 and aligned with the collar pin slot 42 in the sleeve 12 and further aligned with the knurled adjustment collar pin bore 38. The collar pin 20 when pressed into the aligned bores secures the knurled adjustment collar 14 to the jaw guide 32. The collar pin slot 42 restricts the rotation range of the knurled adjustment collar 14 and hence the rotational position of the jaw guide 32 within the sleeve 12. The cam profile top side surfaces 62 and 72 are clearly visible in FIG. 8 as the cross section view is taken along the diameter where the bottom of the arch shaped cam profiles of the bottom portion of the sleeve intersect thereby providing a maximum wall thickness of the sleeve and hence the cam profile top side surfaces 62 and 72. The jaw guide 32 rests on top of the these surfaces and may slide over these surfaces in rotation; however, guide compress spring 36 disposed between the socket body 18 and the jaw guide 32 is engineered so as to provide sufficient friction between the jaw guide 32 and the cam profile top side surfaces 62 and 72 to maintain a rotational position selected by a user.

Figure 10:
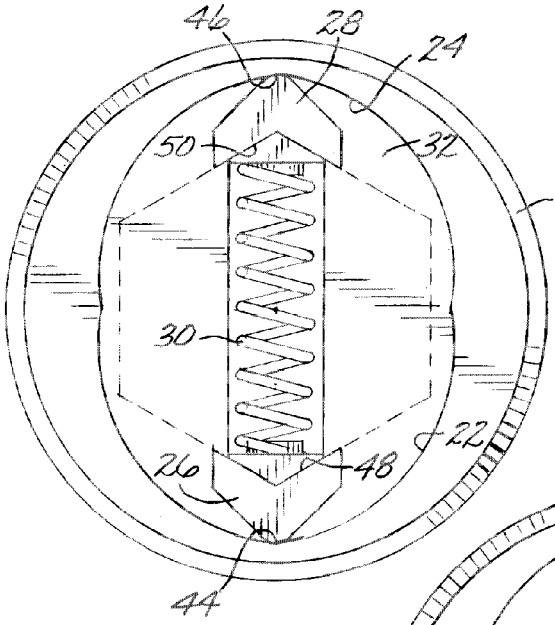
FIG. 10 is a bottom view of the present invention taken on Line 10-10 of FIG. 8 showing the adjustable socket with the jaws in the maximum open configuration.

FIG. 10, taken along Line 10-10 of FIG. 8 illustrates the socket configured with the jaws 26 and 28 with the maximum distance between the jaws representing the largest faceted work piece capacity. The sleeve cam profiles 22 and 24 are clearly visible showing each having an identical arch shape profile wherein the profiles intersect at the base of the arch. Any suitable arch shape may be used including equilateral, parabolic, and lancet shaped arches with the base or springing line span of the arch having a length less than the inside diameter of the opening in the bottom section of the sleeve. In order to achieve a grip equally tight throughout the range of the socket, the arch shape of the cam profile must present a substantially constant pressure angle with respect to the jaws throughout the full adjustment range of the socket. The top of the arch shaped profile is disposed at the inside diameter of the sleeve therefore the wall thickness of the bottom portion of the wall is at a minimum. The base of the arch shaped profile is disposed at a diameter perpendicularly aligned with the center of the collar pin slot of the sleeve, and defines the thickest portion of the bottom portion of the sleeve. When viewed from the bottom of the socket, the arch shaped profiles are disposed in a mirrored orientation. The shorter base lengths provide greater range of adjustment of the distance between the jaws; however, the jaw dimensions limit the base length.

Figure 11:
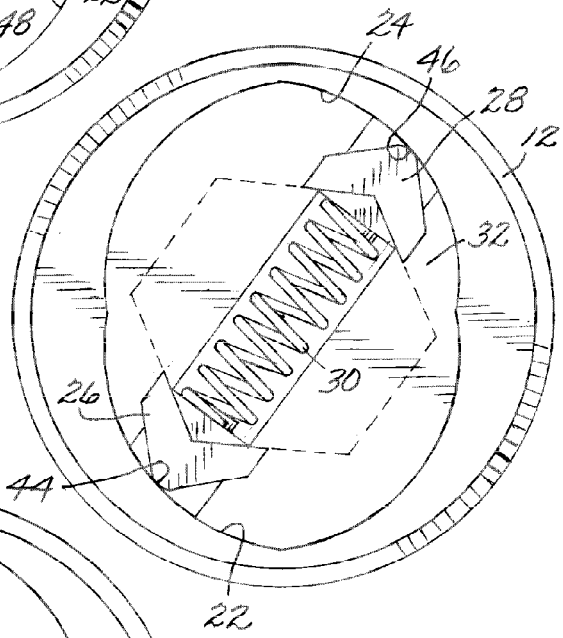
FIG. 11 is a similar view as in FIG. 10 showing the adjustable socket with the jaws adjusted to a mid-range opening configuration.

FIG. 11 is similar to FIG. 10 excepting the rotational position of the jaw guide 32. In FIG. 10, the knurled adjustment collar 14 is positioned at the center of the rotational range such that the jaw cam followers 44 and 46 are disposed at the top of the arch of the cam profiles 22 and 24 and hence providing the maximum distance between the V-shaped grips 48 and 50 of the jaws 26 and 28. The facetted work piece accommodated in FIG. 10 is therefore larger than the facetted work piece illustrated in FIG. 11 wherein the jaw guide 32 has been rotated approximately 45 degrees from the central position as shown in FIG. 10. As the jaw cam followers 44 and 48 interact with the cam profile 22 and 24 surfaces and travel away from the top of the cam profiles 22 and 24, the sleeve 12 walls thicken and the jaws 26 and 28 are forced towards one another. It will be appreciated that as the sleeve 12 rotates as load is applied by a provided wrench, load is transferred to the jaws 24 and 26 through the cam profiles 22 and 24 by means of the jaw cam followers 26 and 28. Having a provide facetted work piece positioned between the V-shaped grips 48 and 50 of the jaws 24 and 26, load is transferred to the work piece. There also exists a load vector between the jaw cam followers 26 and 28 and the cam profile 22 and 24 surfaces that drives the cam followers 26 and 28 further down the cam profiles resulting in a tightening action on the facetted fastener. This tightening feature of the present invention provides an advantage over the prior art wherein prior art drives tend to loosen grip on the work piece when load is applied to the drive.

Figure 12:
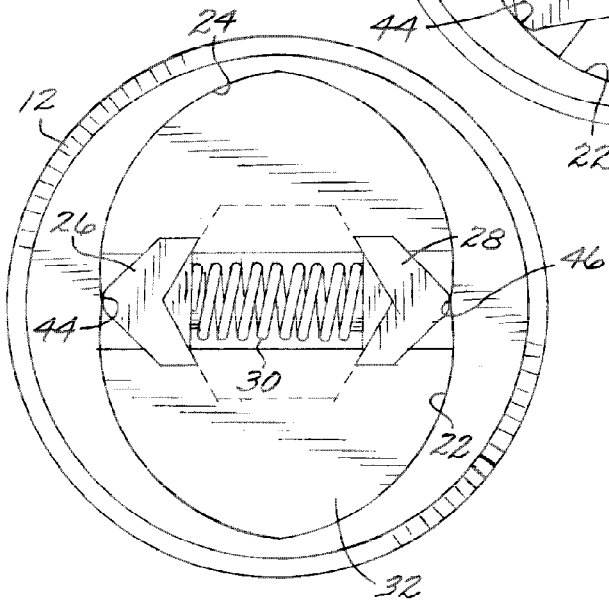
FIG. 12 is a similar view as in FIG. 10 showing the jaws of the adjustable socket in the minimum opening configuration.

FIG. 12 shows the jaw guide 32 rotated 90 degrees from the center line of the guide pin slot 42 of the sleeve 12 representing the smallest distance between the jaws 26 and 28, and hence the smallest facetted work piece accommodated. In this configuration the knurled adjustment collar 14 is positioned at either end of the guide pin slot 42. Note that depending upon the rotational load direction required in a particular use, the user is best advised to select the cam positions such that the jaws tightened upon the fastener when as load is applied. This selection is made by rotating the knurled adjustment collar 14 in the appropriate direction.

The method of operation of the wrench drive socket according to the present invention is dependent upon the direction of torque required to be applied to a provided work piece. Note that depending upon the rotational load direction required in a particular use, the user is best advised to select the cam positions such that the jaws tightened upon the fastener when as load is applied. This selection is made by rotating the knurled adjustment collar 14 in the appropriate direction. If clockwise torque is required, a counterclockwise rotation of the collar 14 is desired. The converse is also true.

Figure 13:
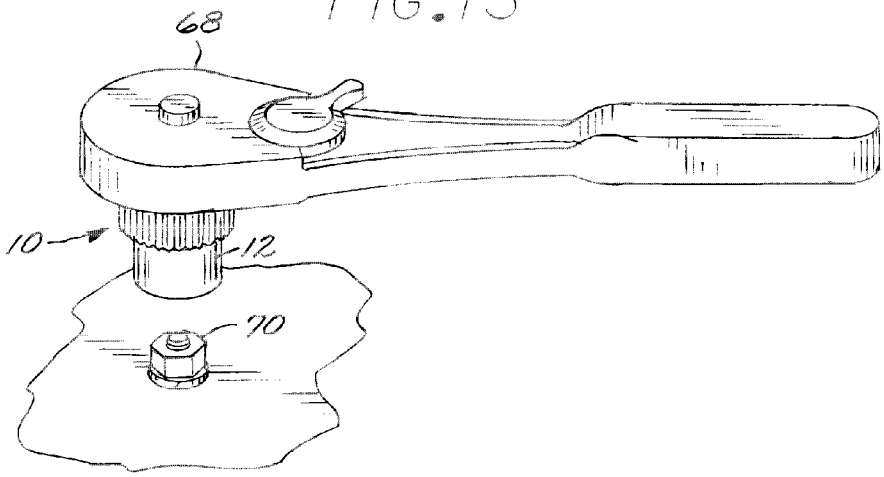
FIG. 13 is a perspective view of the adjustable socket according to the present invention attached to the engaging drive shaft of a ratchet wrench handle and further poised for engaging a faceted work piece between the jaws of the adjustable socket.
Figure 14:
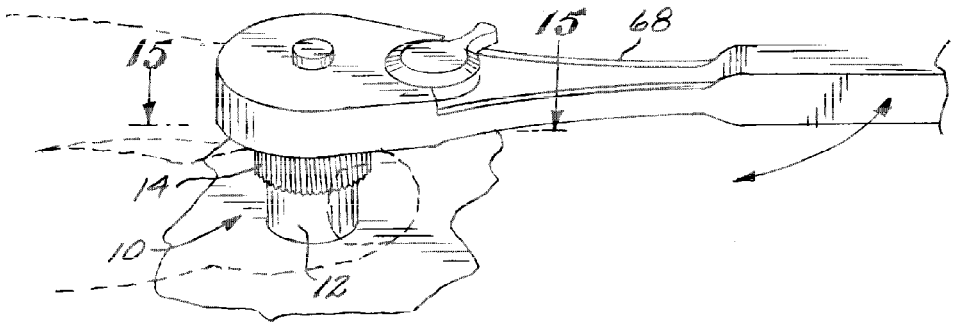
FIG. 14 is a perspective view of the adjustable socket engaged around a faceted work piece and showing a user's thumb and finger in position grasping the knurled adjustment collar so as to selectably dispose the jaws to fully engage the work piece by means of rotation of the ratchet wrench handle so as to position the V-grips of the jaws to compliment the work piece facets and by adjusting the distance between the jaws.
Figure 15:
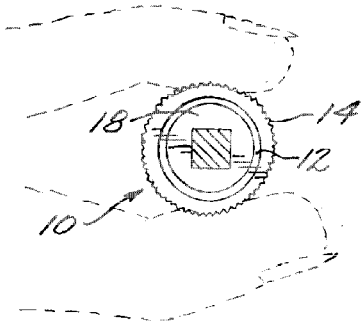
FIG. 15 is a cross section view taken on Line 15-15 of FIG. 14 showing the user finger and thumb positioning to affect the rotation of the knurled adjustment collar around the socket sleeve so as to selectably adjust the distance between the adjustable jaws.

FIG. 13 illustrates the wrench drive socket 10 according to the present position fitted to a drive shaft of a ratchet wrench 68 and poised over a work piece 70. The user places the socket onto the work piece 70, as in FIG. 14, by twisting the collar clockwise or counterclockwise relative to the sleeve 12 until the socket 10 accepts the work piece 70. The jaw spacing is now sufficient to accommodate the work piece 70. With the knurled adjustment collar 14 grasped by the user between thumb and opposing finger as in FIG. 15, to apply clockwise load to the fastener, the user rotates the collar 14 counterclockwise relative to the sleeve 12 and body 18 to tighten the jaws against the work piece 70.

The nature of the construction materials for each of the elements of the tool correspond to the load and wear requirements for each element. Note that the socket has points of interaction between a work piece and the jaw V-shaped grip surfaces, the jaw cam follower and cam profile surfaces, and the socket body and a drive shaft. Consequently any construction material may be used that is suitable to accept the loads required.

While embodiments of this invention have been illustrated and described, variations and modifications may be apparent to those skilled in the art. Therefore, we do not wish to be limited thereto and ask that the scope and breadth of this invention be determined from the claims which follow rather than the above description.

What is claimed is:

1. A cam actuated adjustable socket comprising, a socket sleeve being cylindrically shaped having a top and bottom portion, a horizontally and circumferentially disposed collar pin slot, a socket body being a solid cylinder shape having a top and bottom surface, a circumference, disposed in the top portion of the socket sleeve, at least two arch shaped cam profiles having surfaces formed on the inside circumference of the bottom portion of the socket sleeve, both having identical profiles and disposed mirrored with the bottom of the arch intersecting along a diameter of the sleeve, the cam profiles each further having a top side surface defining the top of the bottom portion of the sleeve and the top surface is disposed below the socket body bottom surface, a jaw guide being a solid cylinder shape having a top and a bottom surface, a circumference with a collar pin receiving bore and a jaw guide slot across the diameter in the bottom surface, and being disposed annularly with the socket sleeve with the bottom contacting the top side surfaces of the cam profiles, a plurality of jaws disposed in the jaw guide slot of the jaw guide each having a cam follower, a slider head, and V-shaped grip being disposed in the jaw guide slot with V-shaped grips facing each other, and with the cam followers arranged to interact with the cam profile surfaces of the sleeve, and, a collar being cylindrically shaped disposed around the outer circumference of the sleeve having collar pin bore receiving a collar pin mounted in the jaw guide collar pin receiving bore and disposed through the horizontally and circumferential collar pin slot of the sleeve whereby the position of the cam followers on the cam profile surfaces are responsive to the rotation of the collar around the circumference of the sleeve thereby facilitating V-shaped grips of the jaws to grasp a provided work piece.

2. The cam actuated adjustable socket as in claim 1 further comprising a jaw compression spring disposed between the jaws within the jaw guide slot so as to provide bias of the jaw cam followers against and for interaction with the sleeve cam profile surfaces.

3. The cam actuated adjustable socket as in claim 2 wherein each jaw further comprises a jaw guide follower captured by the jaw guide slot and having a boss arranged to retain the jaw compression spring.

4. The cam actuated adjustable socket as in claim 1 further comprising a guide compression spring disposed between the bottom surface of the socket body and the top surface of the jaw guide.

5. The cam actuated adjustable socket as in claim 1 wherein the socket body has with at least one body securing pin bore receiving a body securing pin and a drive shaft engaging hole centrally disposed in the top surface.

6. The cam actuated adjustable socket as in claim 5 wherein the drive shaft engaging hole in the top of the socket body is square shaped having four sides wherein each side has a body pin securing bore arranged such that open end of the bore forms a detent to receive locking features of a provided wrench drive shaft.

7. The cam actuated adjustable socket as in claim 5 wherein the body securing pin is a roll pin.

8. The cam actuated adjustable socket as in claim 1 wherein outside circumferential surface of the collar is knurled for improved user grasp.

9. The cam actuated adjustable socket as in claim 1 wherein the arch shape of the cam profile present a constant pressure angle with respect to the jaw throughout the full adjustment range of the socket.

10. The cam actuated adjustable socket as in claim 1 wherein the arch shape of the cam profiles is an equilateral arch profile.

11. The cam actuated adjustable socket as in claim 1 wherein the arch shape of the cam profiles is a parabolic arch profile.

12. The cam actuated adjustable socket as in claim 1 wherein the arch shape of the cam profiles is a lancet arch profile.

13. The cam actuated adjustable socket as in claim 1 wherein the collar pin is a roll pin.

* * * * *